US007516549B2

(12) United States Patent
Asuke

(10) Patent No.: US 7,516,549 B2
(45) Date of Patent: Apr. 14, 2009

(54) NOZZLE PLATE PRODUCING METHOD

(75) Inventor: Shintaro Asuke, Fujimi (JP)

(73) Assignee: Seiko Epson Corporation (JP)

( * ) Notice: Subject to any disclaimer, the term of this patent is extended or adjusted under 35 U.S.C. 154(b) by 401 days.

(21) Appl. No.: 11/326,537

(22) Filed: Jan. 5, 2006

(65) Prior Publication Data

US 2006/0152549 A1 Jul. 13, 2006

(30) Foreign Application Priority Data

Jan. 12, 2005 (JP) ..... 2005-005745

(51) Int. Cl.
*B21D 53/76* (2006.01)
*C23F 1/12* (2006.01)

(52) U.S. Cl. ..... 29/890.1; 347/44; 347/45; 347/46; 216/27; 216/33; 216/42

(58) Field of Classification Search ..... 29/890.1, 29/611, 25.35, 830; 347/44, 45, 46, 47; 216/27, 216/33, 41, 42, 48
See application file for complete search history.

(56) References Cited

U.S. PATENT DOCUMENTS 6,598,957 B2 * 7/2003 Yamamoto et al. ..... 347/44 X
7,086,142 B2 * 8/2006 Kim et al. ..... 29/890.1 X
7,169,537 B2 1/2007 Miura et al.
2007/0052754 A1 3/2007 Amako et al.

FOREIGN PATENT DOCUMENTS

JP 57168838 A * 10/1982 ..... 216/27 X
JP 2004-114415 4/2004
KR 10-2004-0111078 6/2004

* cited by examiner

*Primary Examiner*—A. Dexter Tugbang
(74) *Attorney, Agent, or Firm*—Harness, Dickey & Pierce, P.L.C.

(57) ABSTRACT

A method for producing a nozzle plate comprises a liquid-repellant coat removal step for conducting a plasma treatment to each chip from a same side as a liquid droplet ejecting surface under an atmospheric pressure, while supplying a gaseous mask material for protection of the liquid-repellant coat through nozzle holes from an opposite side of the liquid droplet ejecting surface in such a manner that the gaseous mask material is leaked out over the liquid droplet ejecting surface around the nozzle holes, to thereby remove the liquid-repellant coat exposed outside the mask material; and a bonding step for bonding each chip to the nozzle plate body at the area from which the liquid-repellant coat is removed by the liquid-repellant coat removal step.

8 Claims, 12 Drawing Sheets

NOZZLE PLATE PRODUCING METHOD

CROSS-REFERENCE

The entire disclosure of Japanese Patent Application No. 2005-005745 filed on Jan. 12, 2005 is expressly incorporated by reference herein.

BACKGROUND OF THE INVENTION

1. Field of the Invention

The present invention is directed to a nozzle plate producing method, a nozzle plate, a liquid droplet ejecting head and a liquid droplet ejecting apparatus.

2. Description of the Prior Art

Ink jet heads (liquid droplet ejecting heads) are provided with a nozzle plate on which a plurality of minute nozzle holes are formed at a narrow spacing and is designed to perform printing operations by ejecting ink droplets from apertures (ink ejecting apertures) formed at one side of the nozzle holes and then landing the ink droplets on a printing paper. Reference is made to, for example, JP-A No. 2004-114415.

Some of such ink jet heads are of large size. In such ink jet heads, the size of a nozzle plate is also increased. The large-sized ink jet heads may be composed of a frame-like nozzle plate body and a plurality of small pieces (plate pieces) bonded to the nozzle plate body and having nozzle holes.

In producing the nozzle plate, first of all, a liquid-repellant coat composed of a fluorine-based resin or other like materials is formed on the ink ejecting aperture-side surface of each of the small pieces and on the inner circumferences of the nozzle holes at a region adjacent to each of the ink ejecting apertures. The reason for forming the liquid-repellant coat is that, once ink is adhered to the ink ejecting aperture-side surface of each of the small pieces, the flight trajectory of the ink droplets ejected next time becomes flexed under the influence of surface tension or viscosity of the ink thus adhered, which may cause the ink droplets to be landed on spots deviated from the targets. The liquid-repellant coat is formed to avoid such situation.

At the next step, the small pieces are bonded to the nozzle plate body. For this purpose, the liquid-repellant coat is removed from the bonding areas of the small pieces and then the coat-removed bonding areas of the small pieces are adhesively bonded to the nozzle plate body.

One known example of the method for removing the liquid-repellant coat is a photolithographic method. With this method, however, a large number of steps must be carried out for removal of the liquid-repellant coat, thus making the overall process complicated. This leads to increased costs in producing the nozzle plate.

SUMMARY OF THE INVENTION

Accordingly, it is an object of the present invention to provide a nozzle plate producing method that can easily remove a liquid-repellant coat from the bonding area of a small piece to be bonded to a nozzle plate body and hence can produce a nozzle plate in a cost-effective manner.

Another object of the present invention is to provide a nozzle plate produced by the nozzle plate producing method noted above.

A further object of the present invention is to provide a liquid droplet ejecting head incorporating the nozzle plate noted above.

A still further object of the present invention is to provide a liquid droplet ejecting apparatus incorporating the liquid droplet ejecting head noted above.

With these objects in mind, one aspect of the present invention is directed to a nozzle plate producing method for producing a nozzle plate by bonding a small piece to a nozzle plate body, the small piece having a plurality of nozzle holes from which liquid droplets are to be ejected, a liquid droplet ejecting surface in which the nozzle holes are positioned for ejecting the liquid droplets and a liquid-repellant coat provided on the liquid droplet ejecting surface, and the liquid-repellant coat exhibiting a liquid repellency with respect to the liquid droplets, comprising:

a liquid-repellant coat removal step for conducting a plasma treatment to the small piece from the same side as the liquid droplet ejecting surface of the small piece under an atmospheric pressure, while supplying a gaseous mask material for protection of the liquid-repellant coat through the nozzle holes from the opposite side of the liquid droplet ejecting surface in such a manner that the mask material is leaked out over the liquid droplet ejecting surface around the nozzle holes, to thereby remove the liquid-repellant coat exposed outside the mask material; and a bonding step for bonding the small piece to the nozzle plate body at the area from which the liquid-repellant coat is removed by the liquid-repellant coat removal step.

According to the method described above, it is possible to easily remove the liquid-repellant coat from the bonding area of the small piece to be bonded to the nozzle plate body, and hence it becomes possible to produce the nozzle plate in a cost-effective manner.

In the nozzle plate producing method of the present invention, it is preferred that in the liquid-repellant coat removal step the task of supplying the mask material be performed by mounting a jig having a plurality of flow channels for passage of the mask material on the opposite surface of the small piece from the liquid droplet ejecting surface in such a manner that the flow channels are in communication with the respective nozzle holes, and filling the flow channels with the mask material under the jig-mounted state.

This makes sure that the mask material is leaked out over the liquid droplet ejecting surface around the nozzle holes in a reliable manner.

In the nozzle plate producing method of the present invention, it is also preferred that the quantity of the mask material leaked out over the liquid droplet ejecting surface around the nozzle holes be determined in relation to the flow rate of plasma generation gases used in the plasma treatment.

This helps to control the amount of the liquid-repellant coat removed from the region outside the periphery of each of the nozzle holes.

In the nozzle plate producing method of the present invention, it is preferred that the mask material comprises gases less susceptible to electric discharge than the plasma generation gases used in the plasma treatment and that a parallel plate plasma treatment device be employed to perform the plasma treatment.

This makes it easy to control the quantity of the mask material supplied to the liquid droplet ejecting surface around the nozzle holes, namely, the amount of the liquid-repellant coat removed from the region outside the periphery of each of the nozzle holes.

In the nozzle plate producing method of the present invention, it is preferred that the mask material includes air.

This assures that the liquid-repellant coat is protected from the plasma treatment in a reliable manner.

In the nozzle plate producing method of the present invention, it is preferred that in the bonding step the small piece be bonded to the nozzle plate body by means of an adhesive.

This makes it easy to bond the small piece to the nozzle plate body and therefore makes it less costly to produce the nozzle plate.

In the nozzle plate producing method of the present invention, it is preferred that the liquid-repellant coat be successively formed on an inner circumference of each of the nozzle holes and on the liquid droplet ejecting surface.

This makes it possible to direct the liquid droplets ejected from the nozzle holes toward target spots with increased certainty and uniformity.

In the nozzle plate producing method of the present invention, it is preferred that the liquid-repellant coat be mainly composed of a fluorine-based substance.

This helps to prevent the liquid droplets from adhering to the periphery of each of the nozzle holes and thus ensures that the liquid droplets are stably ejected in a direction generally coinciding with the axis of each of the nozzle holes.

Another aspect of the present invention is directed to a nozzle plate produced by the nozzle plate producing method of the present invention.

This makes it possible to provide a nozzle plate produced in a cost-effective manner.

A further aspect of the present invention is directed to a liquid droplet ejecting head incorporating the nozzle plate of the present invention.

This makes it possible to provide a low-priced liquid droplet ejecting head having a nozzle plate produced in a cost-effective manner.

A still further aspect of the present invention is directed to a liquid droplet ejecting apparatus incorporating the liquid droplet ejecting head of the present invention.

This makes it possible to provide a low-priced liquid droplet ejecting apparatus equipped with a cheap liquid droplet ejecting head.

The above and other objects, features and advantages of the present invention will become apparent from the following description of preferred embodiments given in conjunction with the accompanying drawings.

DETAILED DESCRIPTION OF THE PREFERRED EMBODIMENTS

Now, preferred embodiments of a nozzle plate producing method, a nozzle plate, a liquid droplet ejecting head and a liquid droplet ejecting apparatus in accordance with the present invention will be described in detail with reference to the accompanying drawings.

First Embodiment

This embodiment is directed to an ink jet head that incorporates a liquid droplet ejecting head in accordance with the present invention. Although an ink jet head employing an electrostatic driving system is described in the present embodiment by way of example, it should be appreciated that the invention is not limited to the ink jet head disclosed herein but may be applied to other types of ink jet heads, e.g., a piezoelectric type ink jet head.

Figure 1:
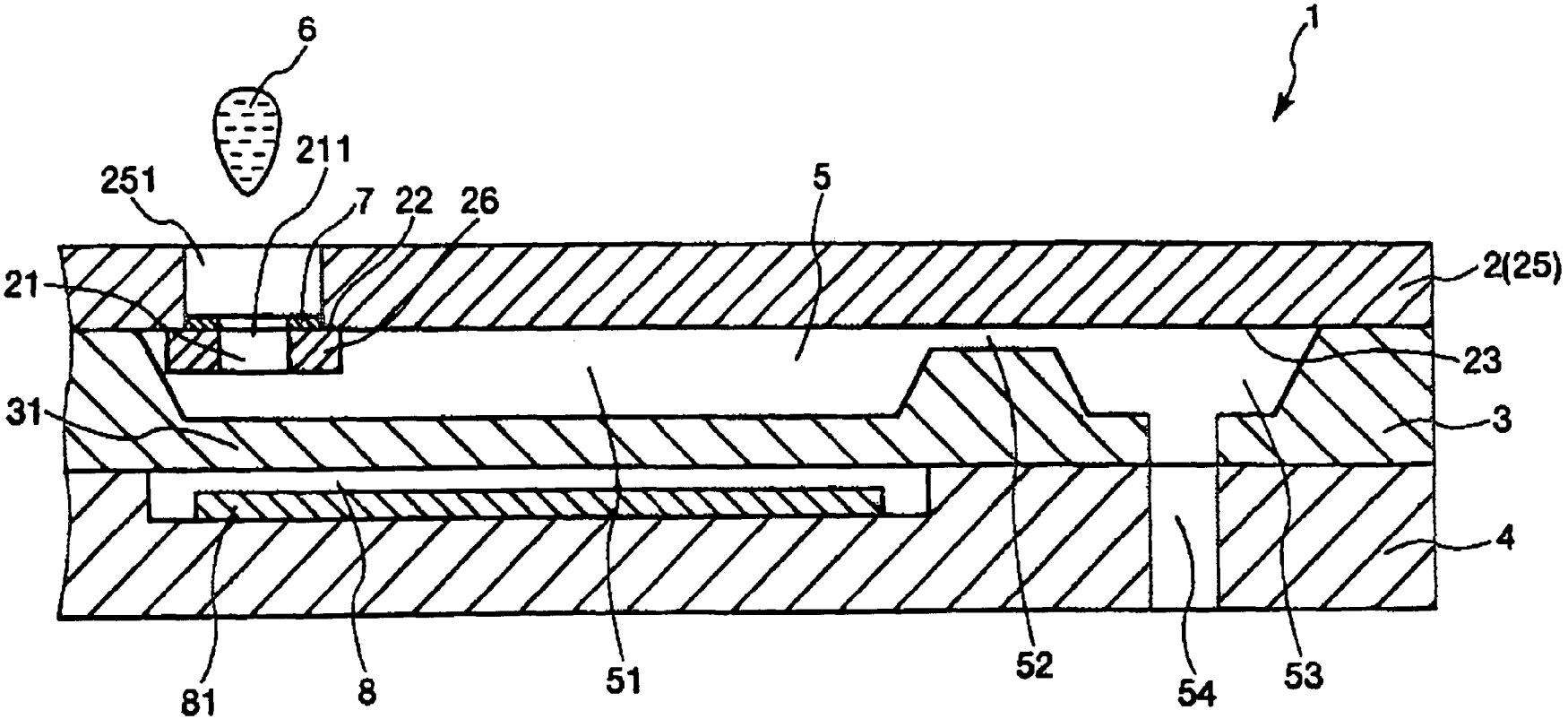
FIG. 1 is a vertical section view showing an embodiment of an ink jet head which incorporates a liquid droplet ejecting head in accordance with the present invention.
Figure 2:
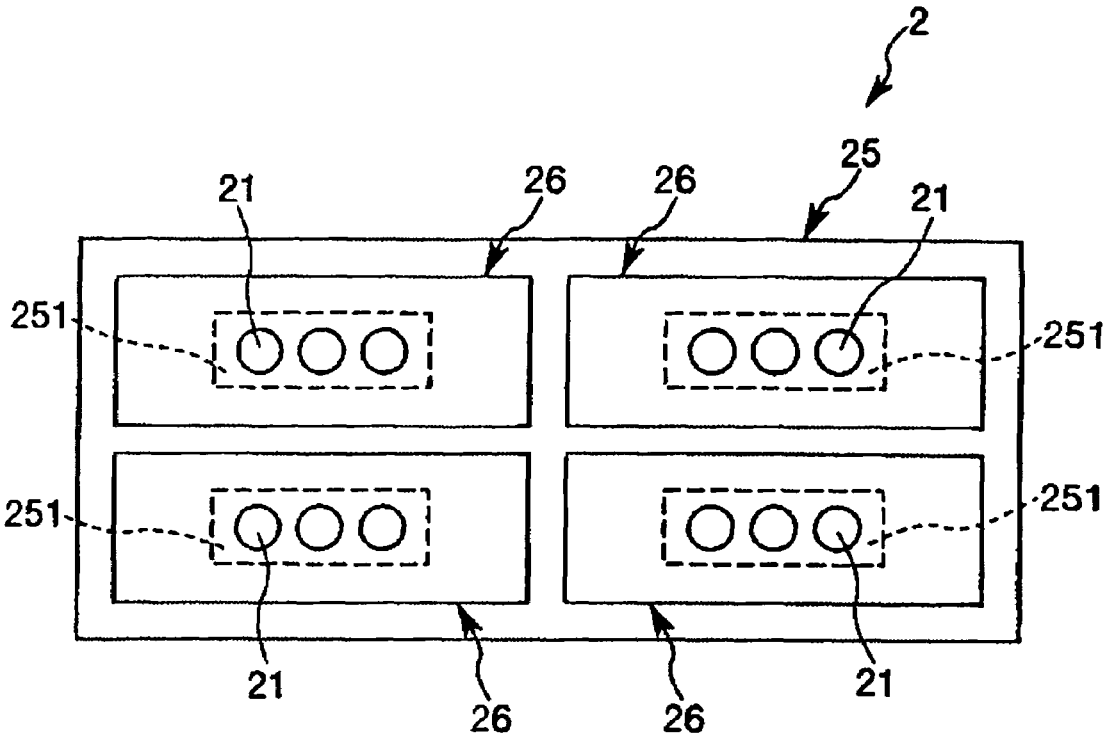
FIG. 2 is a bottom view showing a first embodiment of a nozzle plate employed in the ink jet head shown in FIG. 1.
Figure 3:
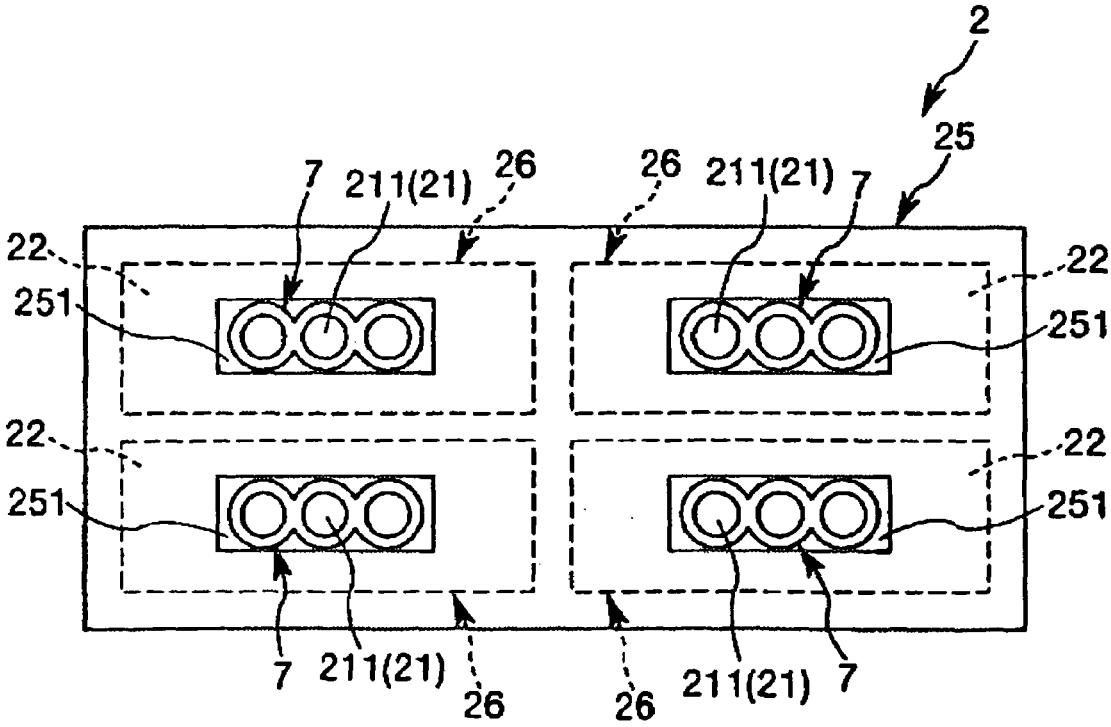
FIG. 3 is a top view showing the nozzle plate employed in the ink jet head shown in FIG. 1.

FIG. 1 is a vertical section view showing an embodiment of an ink jet head which incorporates a liquid droplet ejecting head in accordance with the present invention; FIG. 2 is a bottom view showing a first embodiment of a nozzle plate employed in the ink jet head shown in FIG. 1; and FIG. 3 is a top view showing the nozzle plate employed in the ink jet head shown in FIG. 1.

In these views, the ink jet head is shown upside down as compared to its normal use condition. For the sake of convenience in description, the upper side when viewed in FIG. 1 is referred to as "top", "upper" or its equivalents and the lower side as "bottom", "lower" or its equivalents.

The ink jet head 1 shown in FIG. 1 is of an electrostatically driven type. This ink jet head 1 includes a head body that has a nozzle plate 2, a cavity plate 3 and an electrode plate 4, the cavity plate 3 remaining sandwiched between the nozzle plate 2 and the electrode plate 4.

A plurality of step parts are provided on the cavity plate 3 and a gap 5 is defined between the nozzle plate 2 and the cavity plate 3. The gap 5 is composed of a plurality of mutually separated ink ejecting chambers 51, orifices 52 formed at the rear sides of the respective ink ejecting chambers 51 and a common reservoir 53 for feeding ink to each of the ink ejecting chambers 51. An ink inlet port 54 is formed at the bottom of the reservoir 53.

Those parts of the cavity plate 3 that correspond to the ink ejecting chambers 51 are thin-walled so that they can serve as vibration diaphragms 31 for changing the pressure within the ink ejecting chambers 51.

The electrode plate 4 is bonded to the opposite side of the cavity plate 3 from the nozzle plate 2. The electrode plate 4 has recesses at its parts facing the vibration diaphragms 31 so that vibration chambers 8 can be defined between the electrode plate 4 and the vibration diaphragms 31. On the bottom surface of the vibration chambers 8, individual electrodes 81 are provided in such a positional relationship as to confront the vibration diaphragms 31.

In the ink jet head 1 illustrated, the vibration diaphragms 31, the vibration chambers 8 and the individual electrodes 81 cooperate with one another to provide an electrostatic actuator (liquid droplet ejector means).

With this type of ink jet head 1, if pulse voltages are applied to the individual electrodes 81 by means of a signal generating circuit, the surfaces of the individual electrodes 81 are positively charged, while the corresponding lower surfaces of the vibration diaphragms 31 are charged with negative potential. In response, the vibration diaphragms 31 are bent downwardly by the attracting force of the static electricity generated in this process.

If the pulse voltages are cut off under this state, the electric charges gathered in the individual electrodes 81 and the vibration diaphragms 31 are rapidly discharged and hence the vibration diaphragms 31 is restored substantially to its original shape by the intrinsic resilient force thereof. At this moment, the pressure within the ink ejecting chambers 51 soars up drastically to thereby cause the ink droplets 6 to be ejected toward a recording paper (printing paper P) through respective nozzle holes 21 described later.

Then, if the vibration diaphragms 31 are caused to be bent downwardly-once again, the ink in the reservoir 53 is supplemented to the ink ejecting chambers 51 through the orifices 52.

As shown in FIGS. 1 through 3, the nozzle plate 2 includes a nozzle plate body 25 and a plurality of chips ("small pieces") 26 bonded to the nozzle plate body 25. In the illustrated embodiment, the chips 26 are four in number.

The nozzle plate body 25 is of an elongated rectangular shape (frame-like shape) and has four openings 251 disposed side by side in longitudinal and lateral directions.

Each of the chips 26 is of a reed shape and has a plurality of nozzle holes (through-holes) 21 which are in communication with the ink ejecting chambers 51. In the illustrated embodiment, the nozzle holes 21 are three in number. Each of the nozzle holes 21 provides a flow passageway through which the ink (liquid) can be ejected from the respective ink ejecting chambers 51. The opening formed at the upper side (one side) of each of the nozzle holes 21 constitutes an ink ejecting aperture (outlet aperture) 211 from which the ink is ejected in the form of ink droplets (liquid droplets) 6.

A liquid-repellent coat 7 is formed on a liquid droplet ejecting surface 22 of each of the chips 26 lying at the same side as the ink ejecting apertures 211. As best shown in FIG. 3, the liquid-repellent coat 7 extends around, namely, along the edge region of, the ink ejecting apertures 211 (nozzle holes).

The liquid-repellent coat 7 is a coat that exhibits greater repellency against the ink (ink droplets 6) than the surface of the nozzle plate 2 and has a contact angle of 90 degrees, for example.

Examples of substances for the liquid-repellent coat 7 include, but are not particularly limited to, various kinds of coupling agents with liquid-repellent functional groups such as a fluoroalkyl group, an alkyl group, a vinyl group, an epoxy group, a styryl group and a metacryloxy group; and various kinds of liquid-repellant resin materials such as fluorine-based resins including polytetrafluoroethylene (PTFE), tetrafluoroethylene-perfluoroalkylvinylether copolymer (PFA), ethylene-tertafluoroethylene copolymer (ETFE), perfluoroethylene-propene copolymer (FEP), ethylene-chlorotrifluoroethylene copolymer (ECTFE) and perfluoroalkylether, and a silicon resin.

The liquid-repellent coat 7 formed in this manner prohibits the ink from adhering to the periphery of each of the ink ejecting apertures 211, thus assuring that the ink droplets 6 can be stably ejected in a direction substantially coinciding with the axis of each of the nozzle holes 21.

Each of the chips 26 is bonded to the nozzle plate body 25 so that the liquid-repellent coat 7 can be exposed through the respective openings 251, as can be seen in FIGS. 1 and 3.

Average thickness of the liquid-repellent coat 7 should preferably be, but is not particularly limited to, about 0.01 to 20 μm and more preferably about 0.02 to 0.3 μm.

The nozzle plate 2 having the structure as described above can be produced through the following process.

Figure 6:
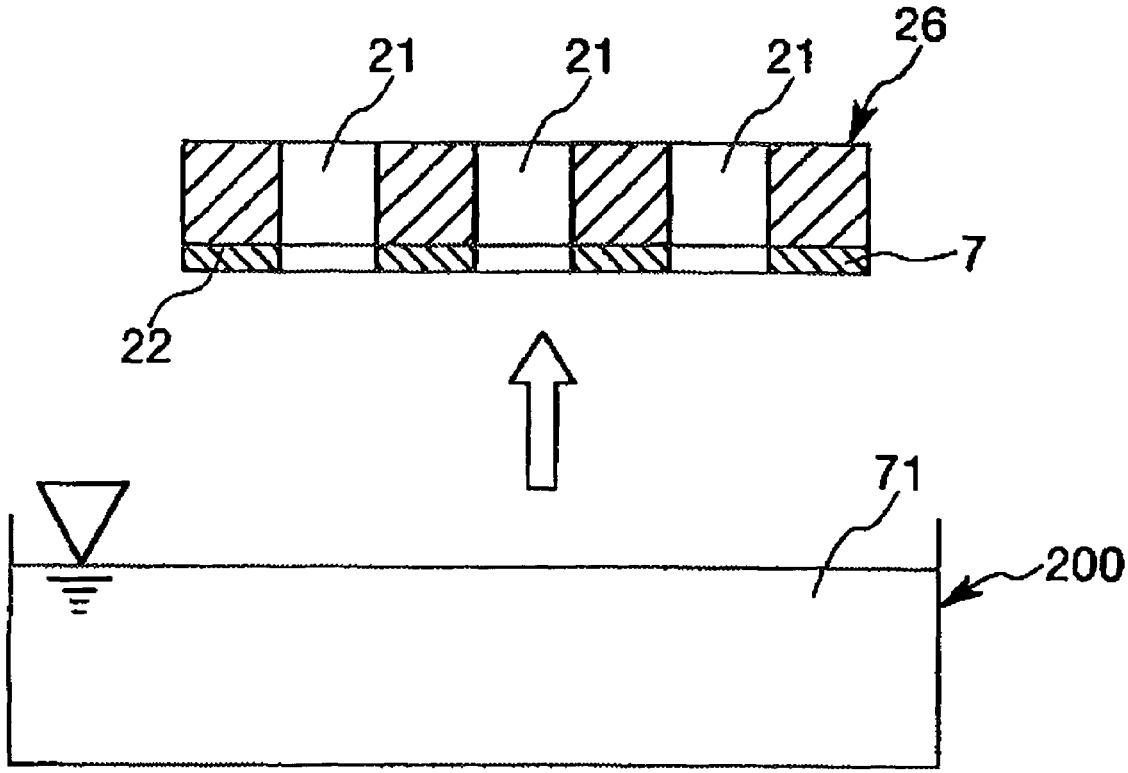
FIG. 6 is a view illustrating a method of producing the nozzle plate shown in FIG. 1.
Figure 7:
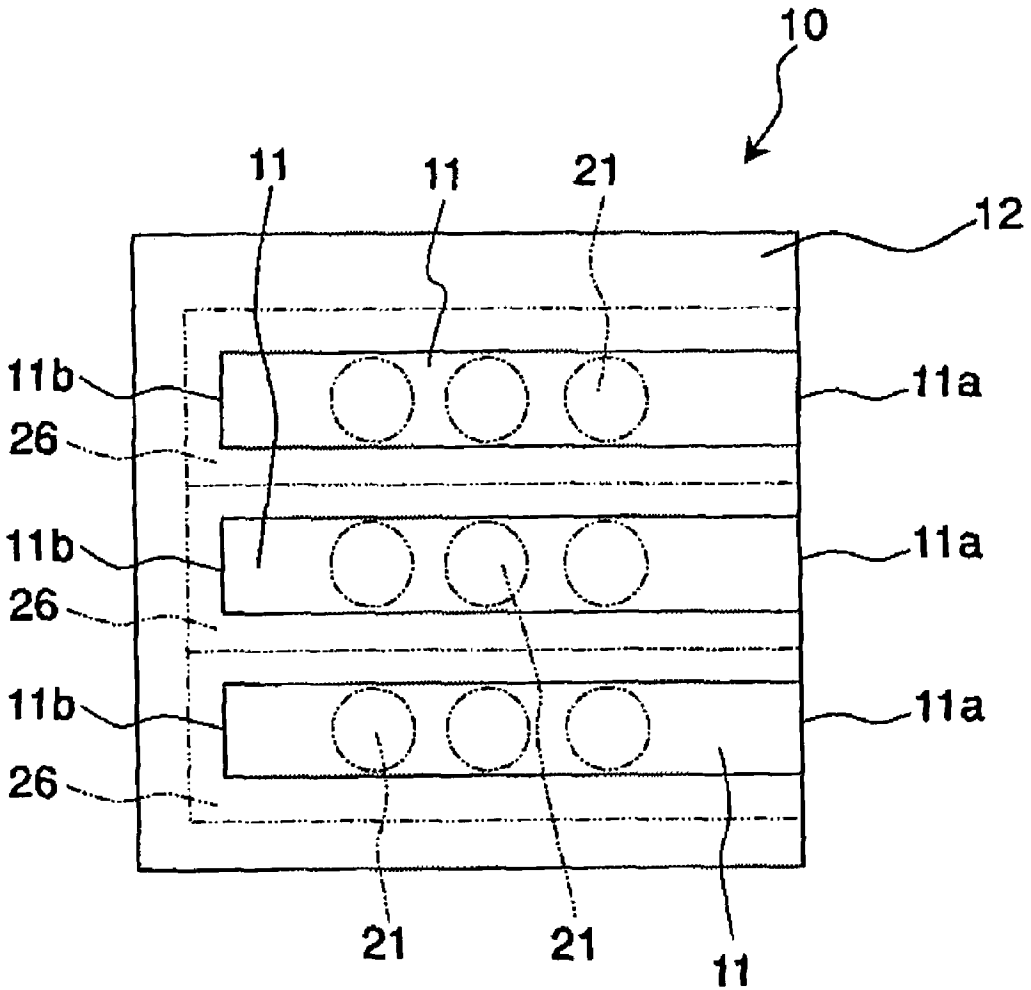
FIG. 7 is a view illustrating a method of producing the nozzle plate shown in FIG. 1.
Figure 8:
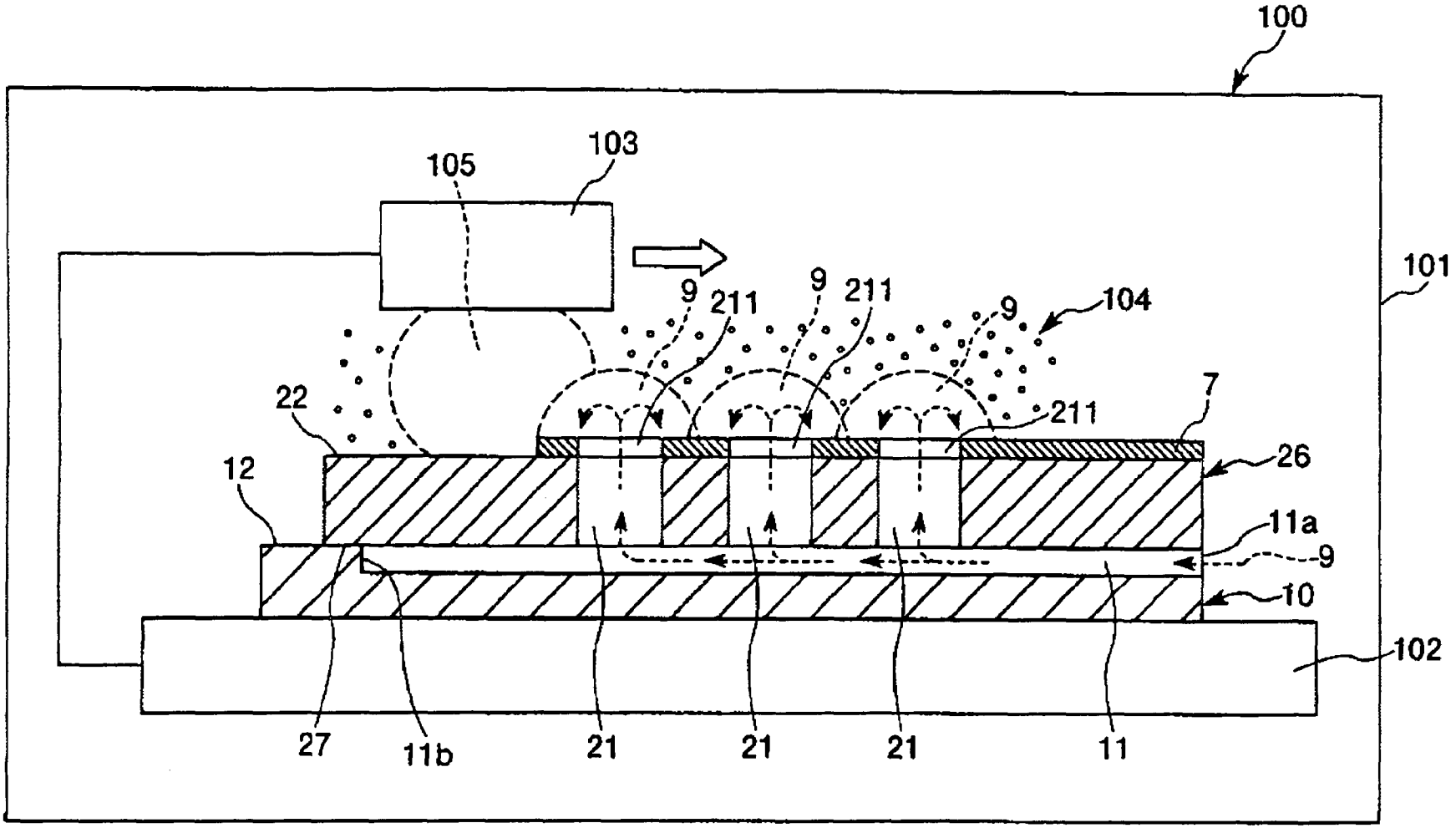
FIG. 8 is a view illustrating a method of producing the nozzle plate shown in FIG. 1.

FIGS. 4 through 10 are views illustrating a method of producing the nozzle plate shown in FIG. 1. A plasma generating device is schematically shown in FIG. 8.

It should be noted that the nozzle plate is shown upside down in FIGS. 4 to 6, 9 and 10 as compared to the nozzle plate illustrated in FIG. 1. For the sake of convenience in description, the upper side when viewed in FIGS. 4 through 6, FIGS. 9 and 10 is referred to as "top", "upper" or its equivalents and the lower side as "bottom", "lower" or its equivalents.

The nozzle plate producing method illustrated in FIGS. 4 through 10 comprises a liquid-repellant coat forming step [1-1], a liquid-repellent coat removal step [1-2], a mask material removal step [1-3] and a bonding step [1-4]. Now, description will proceed regarding the above-listed steps in sequence.

[1-1] Liquid-Repellant Coat Forming Step

Figure 4:
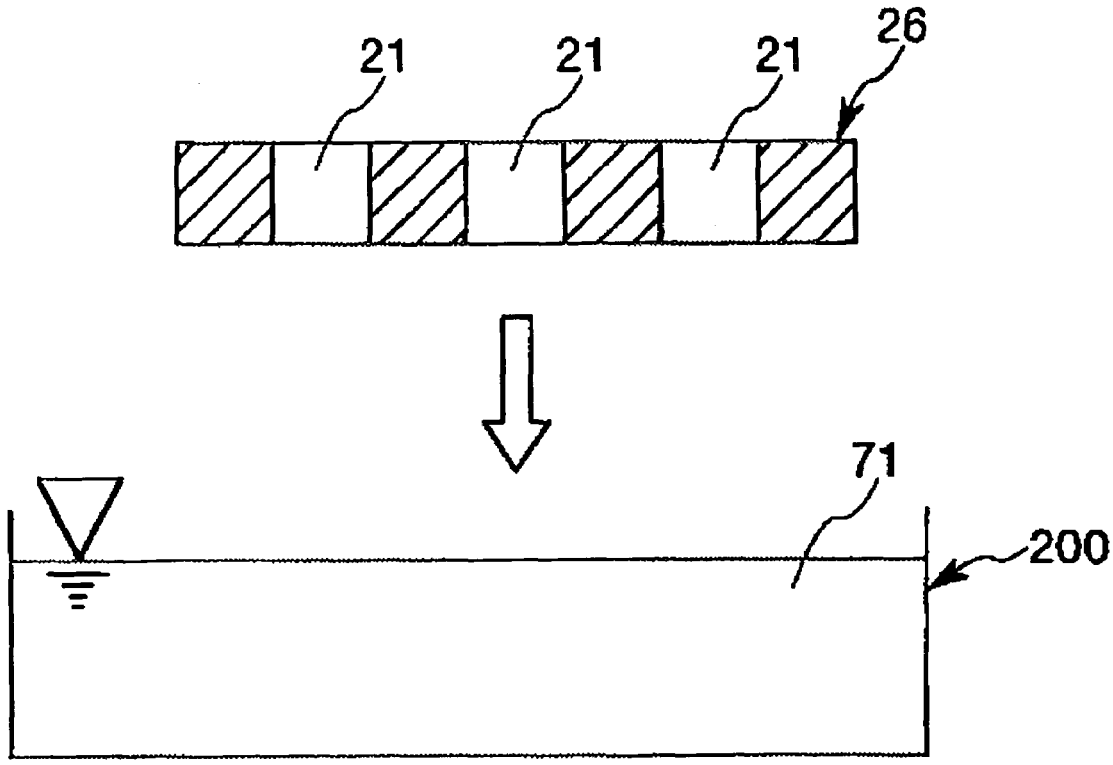
FIG. 4 is a view illustrating a method of producing the nozzle plate shown in FIG. 1.

Initially, as shown in FIG. 4, chips 26 are prepared in plural numbers, each of which has a plurality of nozzle holes 21 mutually spaced apart with a tiny spacing left therebetween.

The chips 26 may be made of, e.g., metal, ceramics, silicon, glass, plastics or the like. Among these materials, it is particularly desirable to prepare the chips 26 by using: metals such as titanium, chromium, iron, cobalt, nickel, copper, zinc, tin and gold; alloys such as a nickel-phosphor alloy, a tin-copper-phosphor alloy (phosphor bronze), a copper-zinc alloy and stainless steel; polycarbonate; polysulphone; an ABS resin (acrylonitrile-butadiene-styrene copolymer); polyethylene terephthalate; polyacetal; or the like.

Figure 5:
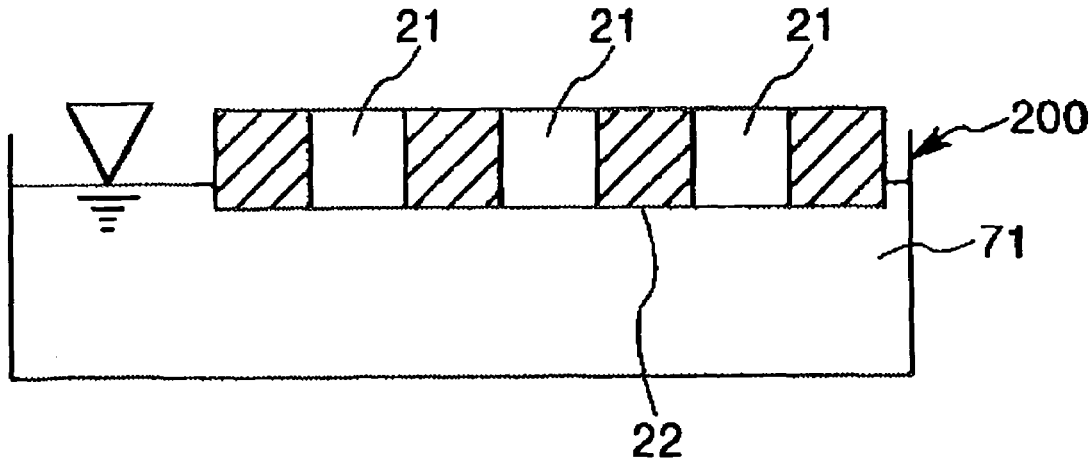
FIG. 5 is a view illustrating a method of producing the nozzle plate shown in FIG. 1.

Subsequently, as shown in FIG. 5, the bottom surface (liquid droplet ejecting surface 22) of the respective chips 26 is dipped into a reservoir 200. This ensures that the bottom surface of the respective chips 26 is brought into contact with a coat material 71 of liquid phase in an easy and reliable manner.

Thereafter, as shown in FIG. 6, the chips 26 are taken out from the reservoir 200, at which time a liquid-repellent coat 7 is formed substantially on the entire bottom surface of each of the chips 26.

The task of bringing the chips 26 into contact with the coat material 71 may be performed by, e.g., a method of applying the coat material 71 on the chips 26 (application method) and a method of showering the chips 26 with the coat material 71, instead of the method of dipping the chips 26 into the coat material 71 (dipping method) as noted above.

[1-2] Liquid-Repellent Coat Removal Step

At first, as illustrated in FIG. 7, a plate-shaped jig 10 is prepared. The jig 10 has a plurality of mutually parallel flow channels (grooves) 11 on the top surface 12 thereof. In the illustrated embodiment, the flow channels 11 are three in number. Each of the flow channels 11 is adapted to pass therethrough gaseous mask material 9 for protection of the liquid-repellent coat 7.

Each of the flow channels 11 has one end 11*a* opened at an end surface of the jig 10 and the other end 11*b* kept closed. The mask material 9 is introduced into the respective flow channels 11 from the open one end 11*a*.

The jig 10 is desirably made of, but is not particularly limited to, a material that exhibits increased contact ability with respect to the chips 26. Examples of the material for the jig 10 include a polyimide resin, a silicon resin and a fluorine resin.

Subsequently, as illustrated in FIG. 8, the jig 10 is detachably mounted to the respective chips 26 in such a manner that the top surface 12 of the jig 10 makes contact (close abutment) with the opposite surface 27 of the respective chips 26 from the liquid droplet ejecting surface 22. At this time, it is important to ensure that the channels 11 of the jig 10 are in communication with (aligned with) the nozzle holes 21 of the chips 26 arranged in a row, as best shown in FIG. 7.

Under the state illustrated in FIG. 7, the chips 26 and the jigs 10 are placed within a plasma treatment device 100 adapted for removal of unnecessary parts of the liquid-repellent coat 7 (see FIG. 8).

Then, the mask material 9 is introduced (filled) into the respective channels 11 from the one end 11*a* thereof. The mask material 9 thus introduced runs through the respective channels 11 and enters the nozzle holes 21 at the midway of the channels 11, after which the mask material 9 is leaked out to the periphery of the nozzle holes 21 (the ink ejecting aperture 211). The mask material 9 used at this time comprises gases capable of protecting the liquid-repellent coat 7 from plasma etching action.

As set forth later, the plasma treatment is conducted preferably by means of a parallel plate type plasma treatment device. In this case, as the mask material 9, gases which is less susceptible to electric discharge than the plasma generation gases 104 used in the plasma treatment is used. Examples of such gases (mask material 9) include air, nitrogen gases and oxygen gases, among which the air is particularly useful. This makes it possible to positively protect the liquid-repellent coat 7 from plasma etching action.

Thereafter, the plasma treatment is conducted to the chips 26 from the same side as the liquid droplet ejecting surface 22 under an atmospheric pressure, while supplying the mask material 9 in the manner as noted above.

One example of the plasma treatment device is shown in FIG. 8. As can be seen in FIG. 8, the plasma treatment device 100 includes a chamber 101, a substrate support stage 102 received in the chamber 101 for supporting the chips 26 and the jigs 10, and a plasma generation head 103 for supplying a plasma toward a minute target area.

The substrate support stage 102 is provided with a built-in type substrate attraction-fixing mechanism (not shown) that serves to affix, by attraction, the jig 10 (chips 26) on the top surface of the substrate support stage 102. Therefore, the jig 10 can be detachably affixed to the substrate support stage 102 by virtue of the substrate attraction-fixing mechanism.

Examples of the substrate attraction-fixing mechanism include, but are not particularly limited to, an electrostatic attraction mechanism adapted for affixing the jig 10 to the substrate support stage 102 by electrostatic attraction forces and a magnetic attraction mechanism capable of affixing the jig 10 to the substrate support stage 102 by magnetic attraction forces.

The plasma generation head 103 is in a spaced-apart relationship with respect to the chips 26 supported on the substrate support stage 102 and can be moved in a direction generally parallel to the top surface (liquid droplet ejecting surface 22) of the chips 26.

In the plasma treatment device 100 shown in FIG. 8, the plasma generation head 103 is of the parallel plate type that has an electric discharge electrode on its surface confronting an object for treatment (the chips 26 with the liquid-repellant coat 7) and generates a plasma in between the electric discharge electrode and the substrate support stage 102 acting as an opposite electrode. Alternatively, the plasma generation head 103 employed in the plasma treatment device 100 may be of a remote plasma type that includes an ion source for generating a plasma, together with an extendible electrode and an accelerator electrode for accelerating the plasma (ions for the most part) generated in the ion source toward an object for treatment.

According to the present invention, it is preferable to use the plasma treatment device 100 of the parallel plate type as shown in FIG. 8. Use of such a plasma treatment device 100 makes it possible to easily control the quantity of the mask material 9 supplied to the periphery of each of the nozzle holes 21, i.e., the amount of the liquid-repellant coat 7 removed from the area outside the periphery of each of the nozzle holes 21.

In order to remove the liquid-repellant coat 7 from the area outside the periphery of each of the nozzle holes 21 by means of the plasma treatment device 100, the plasma generation gases 104 are introduced into the chamber 101 and, concurrently, the plasma generation head 103 is turned on and then caused to move in a direction generally parallel to the liquid droplet ejecting surface 22 of each of the chips 26. At this time, the mask material 9 continues to be supplied in the manner as noted above.

As the plasma generation gases 104 are introduced into the chamber 101, a plasma is generated in between the plasma generation head 103 and the substrate support stage 102 to thereby create a treatment section 105.

If the chips 26 with the liquid-repellant coat 7 pass through the treatment section 105, the liquid-repellant coat 7 exposed outside the mask material 9, namely, the unnecessary part of the liquid-repellant coat 7, is removed from the liquid droplet ejecting surface 22 by an etching action of the plasma, as clearly illustrated in FIG. 8.

The quantity of the mask material 9 leaked out to the periphery of each of the nozzle holes 21 is selected or determined in relation to the flow rate of the plasma generation gases 104 used in the plasma treatment. This helps to control the amount of the liquid-repellant coat 7 removed from the region outside the periphery of each of the nozzle holes 21.

Examples of the plasma used in the plasma treatment include an oxygen plasma and plasmas of inert gases (noble gases) such as argon gases, helium gases, neon gases, xenon gases, krypton gases and the like.

In case of using the oxygen plasma to conduct the plasma treatment, the mixture gases of oxygen gases and inert gases (e.g., helium gases or the like) can be used as the plasma generation gases, for example. In this case, the flow rate of the oxygen gases is preferably about 1 to 500 SCCM and more preferably about 5 to 100 SCCM, whereas the flow rate of the inert gases is preferably about 2 to 50 SLM and more preferably about 5 to 15 SLM.

Furthermore, the radio-frequency output in the plasma treatment device 100 is preferably about 10 to 10,000 W and more preferably about 100 to 250 W.

In addition, the moving (scanning) speed of the plasma generation head 103 is preferably about 1 to 25 mm/sec and more preferably about 5 to 20 mm/sec.

[1-3] Mask Material Removal Step

Figure 9:
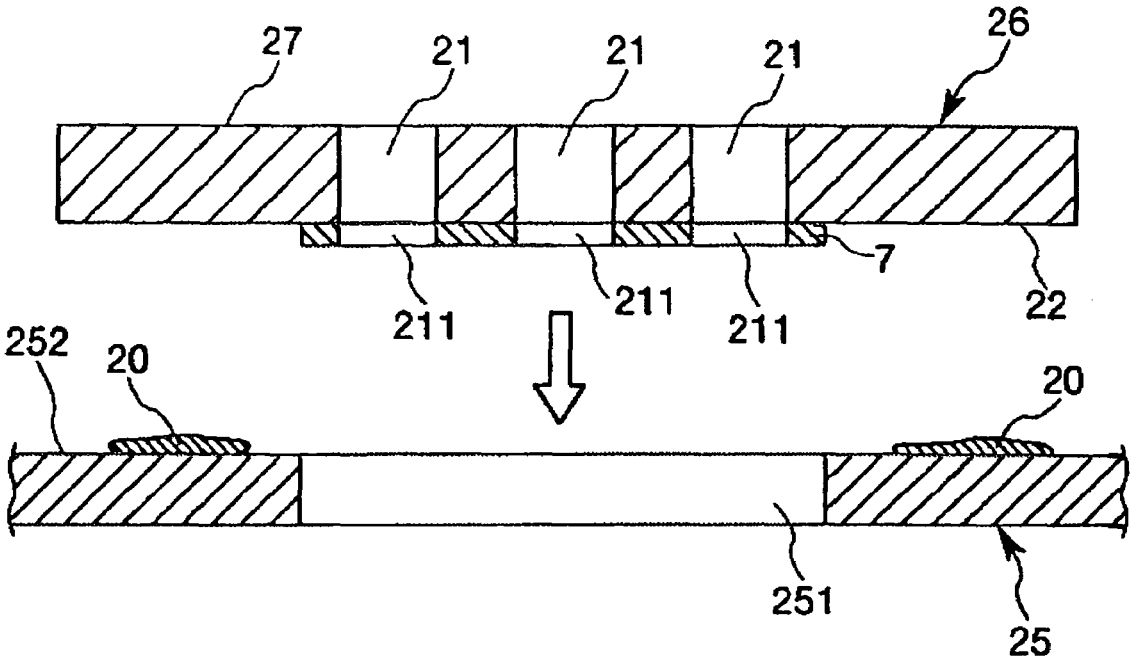
FIG. 9 is a view illustrating a method of producing the nozzle plate shown in FIG. 1.

The jig 10 is detached from the substrate support stage 102, and the chips 26 and the jig 10 are separated from each other. Then, the mask material 9 left in the nozzle holes 21 is removed to acquire the chips 26 as shown in FIG. 9.

The mask material 9, which is of gas phase, can be removed by leaving the mask material 9 under an atmospheric pressure or a vacuum pressure or by blowing inert gases, e.g., nitrogen gases, toward the chips 26.

In case of using the ambient air as the mask material 9 or if there is no need to remove the mask material 9, the step [1-3] may be omitted in its entirety.

Through the afore-mentioned steps, the chips 26 each of which has the liquid-repellant coat 7 on a predetermined region thereof, i.e., on the periphery of each of the nozzle holes 21 are obtained.

[1-4] Bonding Step

A nozzle plate body 25 is produced in advance and brought into a condition for use. As can be seen in FIG. 9, an adhesive agent 20 is applied on the top surface 252 of the nozzle plate body 25 around each of the openings 251.

Figure 10:
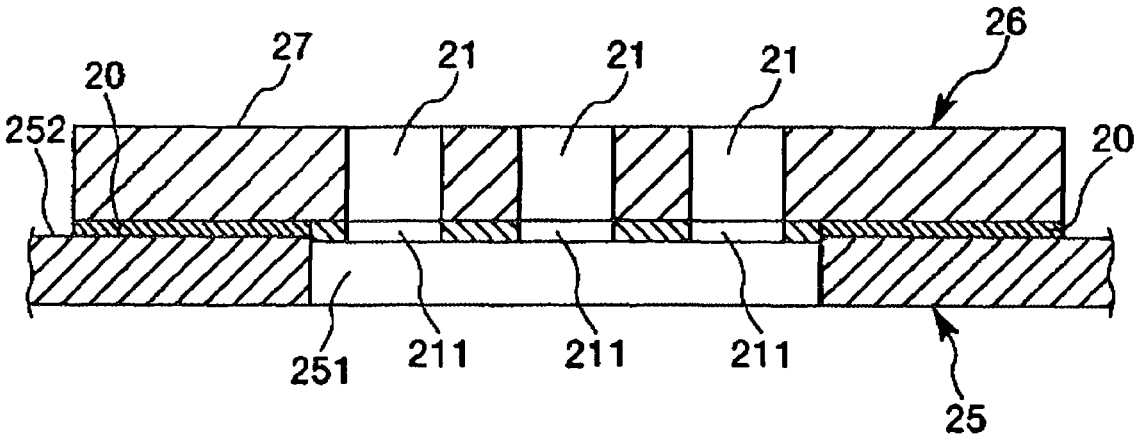
FIG. 10 is a view illustrating a method of producing the nozzle plate shown in FIG. 1.

Then, as illustrated in FIG. 10, those parts of the liquid droplet ejecting surface 22 of the respective chips 26 from which the liquid-repellant coat 7 has been removed are bonded to the top surface 252 of the nozzle plate body 25 with the adhesive agent 20.

By way of going through the steps as described above, it becomes possible to easily remove the liquid-repellant coat 7 from the parts of the chips 26 which are to be bonded to the nozzle plate body 25. This means that the nozzle plate 2 can be produced in a cost-effective manner.

According to the nozzle plate producing method of the present invention, use of the jig 10 makes sure that the mask material 9 is leaked out to the periphery of each of the nozzle holes 21 in a reliable manner.

Moreover, according to the nozzle plate producing method of the present invention, in view of the fact that the chips 26 are bonded to the nozzle plate body 25 through the use of the adhesive agent 20, the bonding task can be performed with ease, thus making it possible to produce the nozzle plate 2 in a cost-effective manner.

In order to form a nozzle plate having a plurality of nozzle holes, the prior art method requires that a liquid-repellant coat is formed on the entire surface of a single sheet nozzle plates. In contrast, according to the nozzle plate producing method of the present invention, the liquid-repellant coat is formed only on the parts requiring formation thereof, namely, on the periphery of the respective nozzle holes. Not only this makes it possible to produce a nozzle plate in a cost-effective manner but also this assists in manufacturing a nozzle plate of big size.

Although, in the illustrated embodiment (see FIG. 7), the jig 10 is mounted to the chips 26 in such a manner that one flow channel 11 of the jig 10 corresponds to one chip 26, it would be equally possible to mount the jig 10 in such a fashion, for example, that nozzle holes 21 of different chips 26 are aligned with each of the flow channels 1. In this case, it is preferred that the pitch (spacing) of the three flow channels 11 be substantially equal to the pitch of the three nozzle holes 21 of the respective chips 26.

Figure 11:
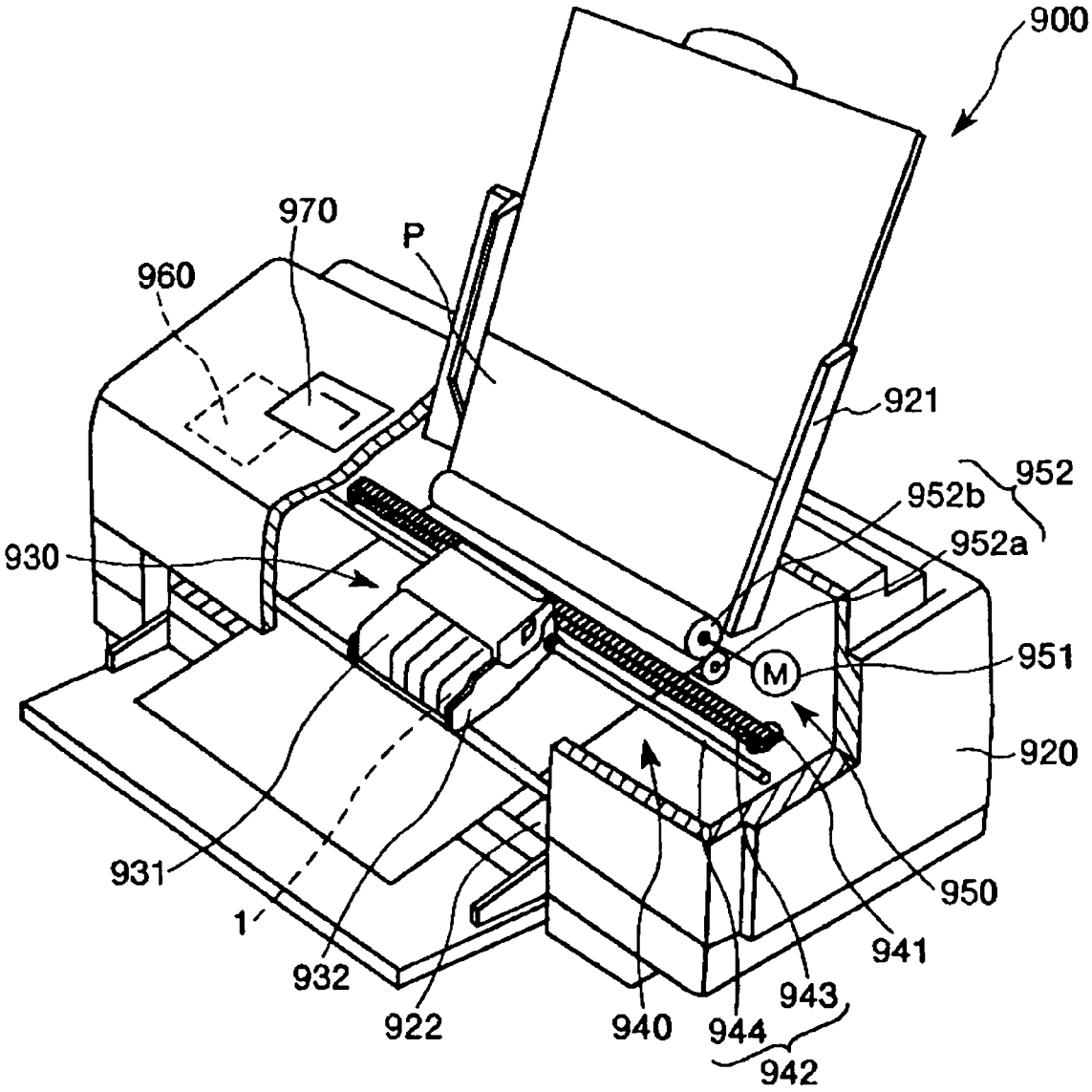
FIG. 11 is a schematic view showing an embodiment of an ink jet printer which incorporates a liquid droplet ejecting apparatus in accordance with the present invention.

The ink jet head 1 having the nozzle plate 2 thus acquired is mounted to an ink jet printer (a liquid droplet ejecting apparatus of the present invention) as shown in FIG. 11.

FIG. 11 is a schematic view showing an embodiment of an ink jet printer which is provided with a liquid droplet ejecting apparatus in accordance with the present invention.

The ink jet printer 900 illustrated in FIG. 11 is provided with a main body 920 that has a tray 921 for holding recording papers P at the top rear part, a discharge opening 922 for discharging the recording papers P therethrough at the bottom front part and a control panel 970 at the top surface.

The control panel 970 is composed of, e.g., a liquid crystal display, an organic EL display, an LED lamp and the like, and comprises a display part (not shown) for indicating error messages or other information and an operation part (not shown) consisting of various kinds of switches.

Provided mainly within the main body 920 are a printing device (printing means) 940 having a reciprocating head unit 930, a paper feeding device (paper feeding means) 950 for feeding the recording papers P to the printing device 940 on a sheet-by-sheet basis, and a control part (control means) 960 for controlling operations of the printing device 940 and the paper feeding device 950.

Under a control of the control part 960, the paper feeding device 950 is adapted to intermittently feed the recording papers P sheet by sheet, which recording papers P pass through beneath the head unit 930. At this time, the head unit 930 is caused to reciprocate in a direction generally orthogonal to the paper feeding direction, whereby printing is performed on the recording papers P. In other words, the reciprocating movement of the head unit 930 and the intermittent feeding of the recording papers P play a role of primary scanning and a role of secondary scanning in the printing process, thereby performing an ink jet printing operation.

The printing device 940 comprises, in addition to the head unit 930, a carriage motor 941 serving as a drive power source of the head unit 930 and a reciprocator mechanism 942 for causing the head unit 930 to reciprocate in response to the rotation of the carriage motor 941.

The head unit 930 comprises an ink jet head 1 having a plurality of nozzle holes 21 (ink ejecting apertures 211) at its bottom side, an ink cartridge 931 for supplying ink to the ink jet head 1 and a carriage 932 which carries the ink jet head 1 and the ink cartridge 931.

The ink cartridge 931 contains ink of four colors, i.e., yellow, cyan, magenta and black, for the purpose of full color printing.

The reciprocator mechanism 942 comprises a carriage guide shaft 944 whose opposite ends are supported on a frame (not shown), and a timing belt 943 extending in a parallel relationship with the carriage guide shaft 944.

The carriage 932 is supported by the carriage guide shaft 944 so as to be movable in a freely reciprocating manner and also fixedly attached to a part of the timing belt 943.

If the timing belt 943 is caused to run in a forward or reverse direction through a pulley by energization of the carriage motor 941, the carriage unit 930 reciprocates along the carriage guide shaft 944, at which time the ink jet head 1 ejects ink in an appropriate manner to perform printing on the recording paper P.

The paper feeding device 950 is provided with a paper feeding motor 951 serving as a drive power source and paper feeding rollers 952 rotated in response to the operation of the paper feeding motor 951.

The paper feeding rollers 952 comprises a driven roller 952*a* and a driving roller 952*b*, both of which are disposed one atop the other in a mutually confronting relationship with a nip for feeding the recording papers P left therebetween. The driving roller 952*b* is operatively connected to the paper feeding motor 951. This assures that the paper feeding rollers 952 can feed, sheet by sheet, the recording papers P held in multiple numbers by the tray 921 toward the printing device 940. In place of the tray 921, it would be possible to detachably mount a paper feeding cassette for storage of the recording papers P to the printer 900.

Based on the data inputted from, e.g., a personal computer or a host computer of a digital camera, the control part 960 is adapted to control the printing device 940, the paper feeding device 950 and the like to thereby perform the printing operation.

Although not shown in the drawings, the control part 960 comprises, among other things, a memory for storing control programs which controls each part of the printer, a drive circuit for applying pulse voltages to the individual electrodes 81 of the ink jet head 1 to thereby control the ink ejecting timing, a drive circuit for driving the printing device 940 (carriage motor 941), a drive circuit for driving the paper feeding device 950 (paper feeding motor 951), a communication circuit for acquiring printing data from a host computer and a CPU electrically connected to these components for performing various control operations.

In addition, electrically connected to the CPU are a variety of sensors that can detect the residual quantity of ink in the ink cartridge 931, the position of the head unit 930 and the like, for example.

The control part 960 is adapted to acquire the printing data via a communication circuit and store the printing data in the memory. The CPU serves to process the printing data and supply drive signals to each of the drive circuits, based on the data thus processed and the input data from the sensors. In response to the drive signals, an electrostatic actuator, the printing device 940 and the paper feeding device 950 perform their own operations so that the printing can be done on the recording papers P.

Second Embodiment

FIGS. 12 through 15 are views illustrating a method of producing a nozzle plate according to a second embodiment of the present invention. For the sake of convenience in description, the upper side when viewed in FIGS. 12 through 15 is referred to as "top", "upper" or its equivalents and the lower side as "bottom", "lower" or its equivalents.

Now, a method of producing a nozzle plate according to a second embodiment of the present invention will be described with reference to FIGS. 12 through 15. The following description is centered on the points differing from the preceding embodiment, with no description offered regarding the same matters as in the preceding embodiment.

The present embodiment is the same as the first embodiment except that a liquid-repellant coat is formed on different parts of chips than in the first embodiment.

Figure 15:
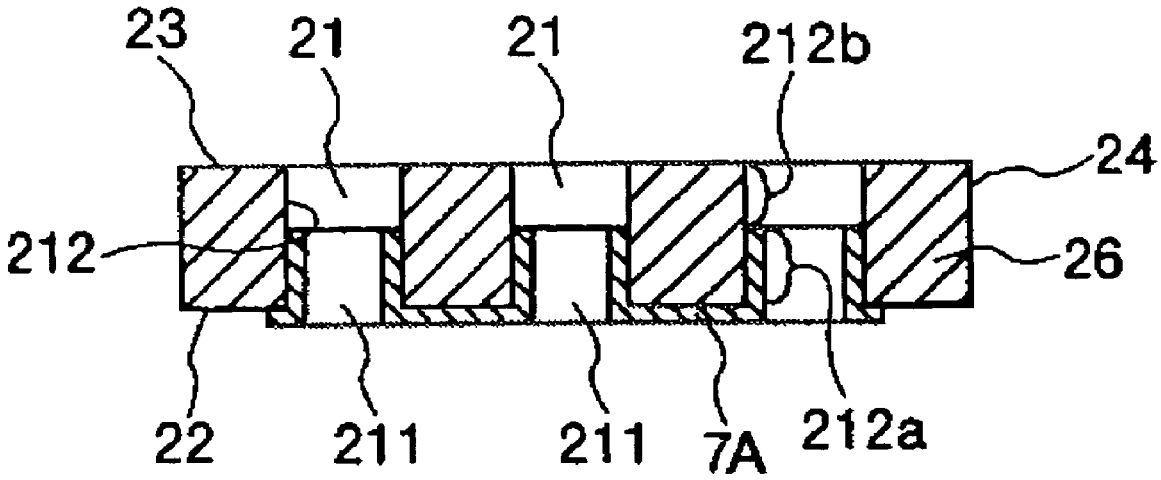
FIG. 15 is a view illustrating a method of producing a nozzle plate according to a second embodiment of the present invention.

As illustrated in FIG. 15, a liquid-repellant coat 7A is successively formed on an inner circumference of each of nozzle holes 21 and on a liquid droplet ejecting surface 22. In other words, the liquid-repellant coat 7A is formed on each of chips 26 to continuously extend over the liquid droplet ejecting surface 22 lying at the same side as ink ejecting apertures 211 and over a partial region of an inner circumference 212 of the respective nozzle holes 21 adjoining the ink ejecting apertures 21, i.e., a partial region 212*a* of an inner circumference 212 of the respective nozzle holes 21 running a predetermined length from the top end (one end) toward the bottom end (the other end) of the respective nozzle holes 21.

Such a liquid-repellant coat 7A is formed by a coating method set forth below. The coating method comprises a coat preform forming step [2-1], an unnecessary part removal step [2-2] and a mask material removal step [2-3].

[2-1] Coat Preform Forming Step

Figure 12:
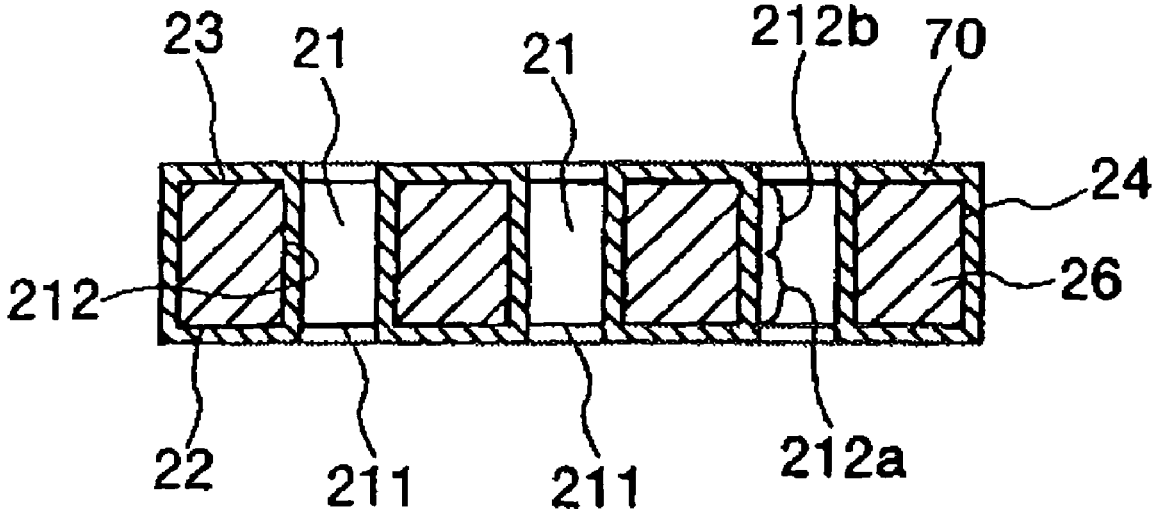
FIG. 12 is a view illustrating a method of producing a nozzle plate according to a second embodiment of the present invention.

Initially, as illustrated in FIG. 12, a coat preform 70 for creating the liquid-repellant coat 7A is formed, by a dipping method, on the entire surface of each of chips 26, namely, substantially on the whole surface of an inner circumference 212 of the respective nozzle holes 21 (including a partial region 212*a*) and on the external surface of each of chips 26.

[2-2] Unnecessary Part Removal Step

Figure 13A:
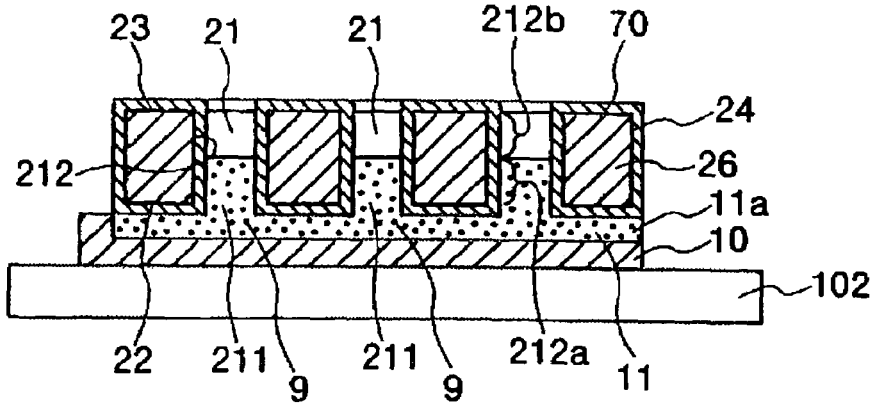
FIG. 13 is a view illustrating a method of producing a nozzle plate according to a second embodiment of the present invention.
Figure 13B:
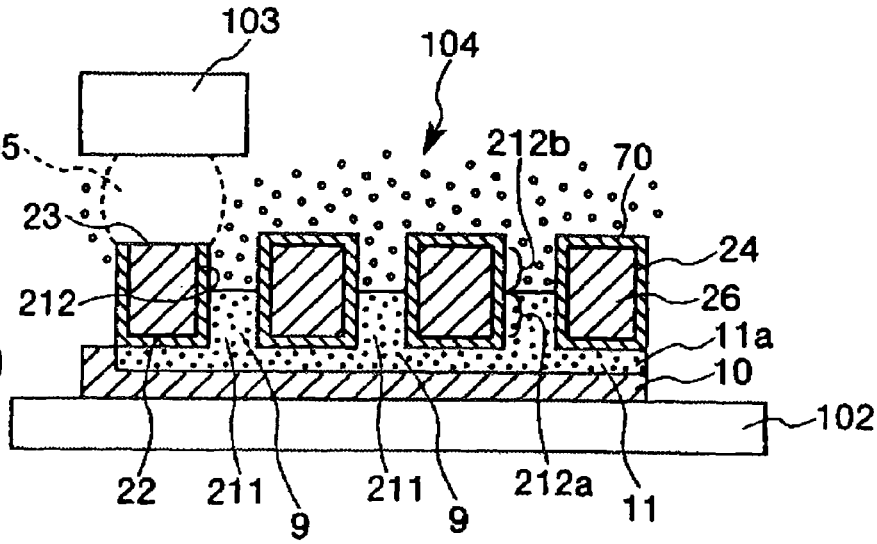

Subsequently, as illustrated in FIG. 13(*a*), a mask material 9 is filled (supplied) through flow channels 11 into the nozzle holes 21 of each of the chips 26 on which the coat preform 70 has been formed in the preceding step.

Then, while supplying the mask material 9, a plasma treatment (atmospheric pressure plasma treatment) is performed with respect to the chips 26 under an atmospheric pressure from the opposite side of the ink ejecting apertures 211 (the other end side of the nozzle holes 21).

As illustrated in FIG. 13(*b*), if the chips 26 with the coat preform 70 pass through a treatment section 105, the coat preform 70 formed on the top surface 23 of each of the chips 26 is removed by a plasma etching.

Figure 14C:
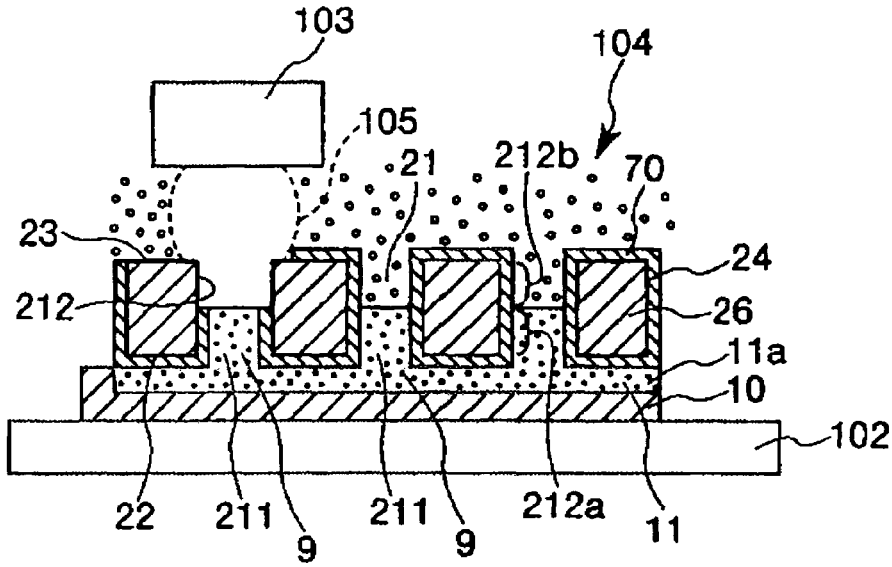
FIG. 14 is a view illustrating a method of producing a nozzle plate according to a second embodiment of the present invention.
Figure 14D:
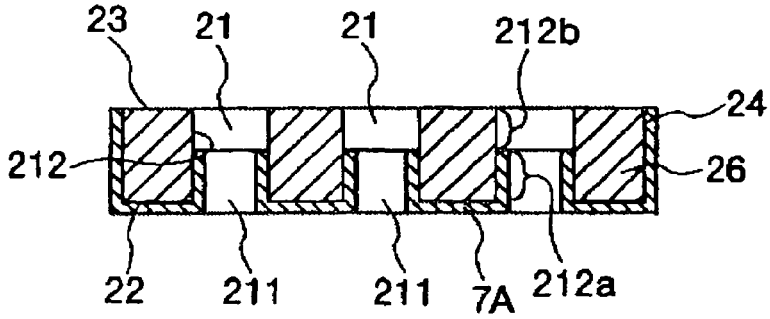

Furthermore, as illustrated in FIG. 14(*c*), if a plasma is supplied into the nozzle holes 21, the coat preform 70 exposed outside the mask material 9 (formed on a region 212*b*) is removed by the plasma etching.

By way of conducting such a plasma treatment with respect to the top surface 23 of each of the chips 26 and the nozzle holes 21, unnecessary parts of the coat preform 70 are removed from the chips 26 while leaving intact the coat preform 70 on the surface 22 of each of the chips 26 at the side of the ink ejecting apertures 211, on the flank surface 24 and on the partial region 212*a* of the inner circumference 212 of the respective nozzle holes 21.

Thereafter, the coat preform 70 subsisting on other regions than the periphery of each of the nozzle holes 21 is removed through substantially the same step as step [1-2] in the first embodiment described earlier. If needed, the coat preform 70 formed on the flank surface 24 of each of the chips 26 may be removed.

[2-3] Mask Material Removal Step

The jig 10 is detached from the substrate support stage 102, and the chips 26 and the jig 10 are separated from each other. Then, the mask material 9 left in the nozzle holes 21 is removed to obtain the chips 26 as shown in FIG. 14(*d*).

The mask material 9, which is of gas phase, can be removed by leaving the mask material 9 under an atmospheric pressure or a vacuum pressure or by blowing inert gases, e.g., nitrogen gases, toward the chips 26.

In case of using the ambient air as the mask material 9 or if there is no need to remove the mask material 9, the step [2-3] may be omitted in its entirety.

Through the afore-mentioned steps, the chips 26 are obtained that has the liquid-repellant coat 7A on a predetermined region. This liquid-repellant coat 7A makes it possible to direct the liquid droplets 6 ejected from the nozzle holes 21 toward target spots on a recording paper P with increased reliability and uniformity.

Although the nozzle plate producing method, the nozzle plate, the liquid droplet ejecting head and the liquid droplet ejecting apparatus in accordance with the present invention have been set forth in the foregoing in respect of the illustrated embodiments, it should be noted that the invention is not limited to the particular embodiments disclosed herein.

For example, the number of chips provided on the nozzle plate body is not limited to four but may be changed to one, two, three or more than four. Likewise, the number of nozzle holes formed in the chips is not limited to three but may be changed to two or more than three.

It would also be possible, in the process of supplying the mask material, to mount a reflection plate in a confronting relationship with the liquid ejecting apertures so that the reflection plate can reflect the mask material as the mask material is discharged (leaked out) from the liquid ejecting apertures. This ensures that the mask material makes contact with the liquid-repellant coat in a reliable manner, thus positively protecting the liquid-repellant coat from the plasma.

Moreover, the liquid droplet ejecting head of the present invention may be applied to different kinds of heads that has a flow passageway (through-hole) of small diameter as in a variety of dispensing nozzles, for instance.

Although preferred embodiments of the present invention have been set forth in the foregoing, it will be apparent to those skilled in the art that various changes or modifications may be made thereto within the scope of the invention defined by the claims.

What is claimed is:

1. A nozzle plate producing method for producing a nozzle plate by bonding a small piece to a nozzle plate body, the small piece having a plurality of nozzle holes from which liquid droplets are to be ejected, a liquid droplet ejecting surface in which the nozzle holes are positioned for ejecting the liquid droplets and a liquid-repellant coat provided on the liquid droplet ejecting surface, and the liquid-repellant coat exhibiting a liquid repellency with respect to the liquid droplets, comprising:

a liquid-repellant coat removal step for conducting a plasma treatment to the small piece from a same side as the liquid droplet ejecting surface of the small piece under an atmospheric pressure, while supplying a gaseous mask material for protection of the liquid-repellant coat through the nozzle holes from an opposite side of the liquid droplet ejecting surface of the small piece in such a manner that the gaseous mask material is leaked out over the liquid droplet ejecting surface around the nozzle holes, to thereby remove at least one portion of the liquid-repellant coat exposed outside the gaseous mask material; and a bonding step for bonding the small piece to the nozzle plate body at an area from which the at least one portion of liquid-repellant coat is removed by the liquid-repellant coat removal step.

2. The method as claimed in claim 1, wherein in the liquid-repellant coat removal step, the task of supplying the gaseous mask material is performed by mounting a jig having a plurality of flow channels for passage of the gaseous mask material on the opposite surface of the small piece from the liquid droplet ejecting surface in such a manner that the flow channels are in communication with the respective nozzle holes, and filling the flow channels with the gaseous mask material while the jig is mounted.

3. The method as claimed in claim 1, wherein a quantity of the gaseous mask material leaked out over the liquid droplet ejecting surface around the nozzle holes is determined in relation to a flow rate of plasma generation gases used in the plasma treatment.

4. The method as claimed in claim 1, wherein the gaseous mask material comprises gases less susceptible to electric discharge than plasma generation gases used in a plasma treatment and a parallel plate plasma treatment device is employed to perform the plasma treatment.

5. The method as claimed in claim 1, wherein the gaseous mask material includes air.

6. The method as claimed in claim 1, wherein, at the bonding step, the small piece is bonded to the nozzle plate body by means of an adhesive.

7. The method as claimed in claim 1, wherein the liquid-repellant coat is successively formed on an inner circumference of each of the nozzle holes and on the liquid droplet ejecting surface.

8. The method as claimed in claim 1, wherein the liquid-repellant coat is mainly composed of a fluorine-based substance.

* * * * *